US007201401B1

(12) United States Patent
Friedman

(10) Patent No.: US 7,201,401 B1
(45) Date of Patent: Apr. 10, 2007

(54) COLLAPSIBLE SNOWBOARDER POLE

(76) Inventor: Steven Friedman, 1475 Florida St., San Francisco, CA (US) 94110

( * ) Notice: Subject to any disclaimer, the term of this patent is extended or adjusted under 35 U.S.C. 154(b) by 0 days.

(21) Appl. No.: 11/187,651

(22) Filed: Jul. 22, 2005

(51) Int. Cl.
*A63C 11/22* (2006.01)

(52) U.S. Cl. ..... 280/823; 280/824; 135/66; 135/70

(58) Field of Classification Search ..... 280/823, 280/824, 819, 812, 816; 135/66, 70
See application file for complete search history.

(56) References Cited

U.S. PATENT DOCUMENTS

| | | | | |
|---|---|---|---|---|
| 2,705,015 | A * | 3/1955 | Langlais | 52/632 |
| 3,669,133 | A * | 6/1972 | Hyman | 135/74 |
| 3,730,544 | A * | 5/1973 | Hyman | 280/819 |
| 3,963,037 | A * | 6/1976 | Clark | 135/65 |
| 4,596,405 | A * | 6/1986 | Jones | 280/823 |
| 4,979,531 | A * | 12/1990 | Toor et al. | 135/127 |
| 5,941,435 | A * | 8/1999 | Munro, III | 224/267 |
| 6,003,915 | A * | 12/1999 | Bierman | 294/51 |
| 6,217,072 | B1 | 4/2001 | Gregg | |
| 6,217,073 | B1 * | 4/2001 | Hoffman | 280/823 |
| 6,273,112 | B1 * | 8/2001 | Sumida | 135/75 |
| 6,345,843 | B1 * | 2/2002 | Barnes | 280/823 |
| 6,557,572 | B2 * | 5/2003 | Lah | 135/114 |
| 6,678,989 | B1 * | 1/2004 | Lowe | 43/6 |
| 6,938,927 | B1 * | 9/2005 | Martin et al. | 280/819 |
| 2003/0122390 | A1 * | 7/2003 | Slauf | 294/19.1 |
| 2005/0104359 | A1 * | 5/2005 | Spragg et al. | 280/823 |
| 2006/0163865 | A1 * | 7/2006 | Smith et al. | 280/821 |

OTHER PUBLICATIONS

Unknown Author, "The Snowboard Pole", at www.theboarderline.com/snowboardpole.html, date unknown (archived at www.archive.org as of Jan. 2, 2002).

* cited by examiner

*Primary Examiner*—J. Allen Shriver
(74) *Attorney, Agent, or Firm*—Amir H. Raubvogel

(57) ABSTRACT

A collapsible snowboarder pole is divided into a number of segments. The segments are stored in a housing that also functions as a handle when the pole is in use. Tent pole technology enables the segments to fold out and hold shape. The pole segments mate with one another and are held in place by an elastic cord. The cord provides sufficient elasticity to allow the user to pull apart the pole segments enough to disengage them from one another when collapsing the pole.

24 Claims, 5 Drawing Sheets

COLLAPSIBLE SNOWBOARDER POLE

BACKGROUND OF THE INVENTION

1. Field of the Invention

The present invention relates to a collapsible pole for use by snowboarders and/or other outdoor enthusiasts.

2. Description of the Related Art

Poles are part of the skier's standard equipment. Ski poles serve a variety of functions, such as for example assisting in traversing flat or uphill terrain; the skier pushes the poles into the snow to propel him- or herself forward. Skiers also use poles when traveling downhill, for example to establish a pivot point (pole plant) when slaloming or otherwise making a short radius turn.

Snowboarders generally do not carry poles, and do not generally benefit from poles when traveling downhill. However, there are times when snowboarders could benefit from a pole, particularly when traversing flat or uphill terrain. Without a pole, such traversals can be arduous and frustrating, as the snowboarder's sole means of propulsion is to repeatedly shift body weight in an effort to achieve forward momentum. Often, such an attempt is unsuccessful, forcing the snowboarder to sit down, unbuckle his or her equipment so that one foot is free, and kick him- or herself forward with the free foot while trying to keep an interfering twisted front knee from realigning to its natural position. Then, once the traversal is complete, the snowboarder must re-buckle the equipment.

Having a pole would be of great utility to a snowboarder who finds him- or herself in such a position. However, most snowboarders find it too awkward to carry a pole, particularly since they have no use for the pole when traveling downhill. A full-length pole would thereby be a burden more often than it would be of use.

Some snowboarders carry telescoping poles, such as those designed for backcountry skiing, telemarking, or trekking. These poles can be made smaller when they are not in use. However, in general such poles are usually adjustable from approximately 25" to 60", and therefore cannot be made small enough to be truly convenient for the snowboarder.

A limitation of telescoping poles is the inability to provide a large number of pole segments. A telescoping pole includes a number of sliding, overlapping cylindrical segments having successively smaller diameters. The pole is collapsed by sliding smaller segments into larger ones, until only the largest segment (plus the handle) is exposed. Because of required wall thicknesses for each cylinder, and because cylinders must fit inside one another, usually only three segments can be accommodated. As a result, such telescoping poles are typically collapsible only to a size equaling the size of the handle plus one-third of the overall pole length. Given a desired overall length of 60" and a handle length of 5", the smallest length for a telescoping pole is approximately 25", which is too large to be convenient for a snowboarder. Attempting to include additional segments causes some of the segments to be either too thick (which adds excessive weight and bulk) or too narrow (which compromises the strength of the pole).

In addition, such telescoping poles are subject to additional disadvantages. They may tend to collapse undesirably and unintentionally when a significant amount of force is applied, for example when using the pole for pushing uphill. Also, they are prone to failure, jamming, icing, and locking up.

U.S. Pat. No. 6,217,073, to Hoffman, for "Collapsible Snow Pole," describes an extendable and retractable snow pole for use by snowboarders. Hoffman's snow pole uses a telescoping mechanism which is subject to the problems and limitations set forth above.

U.S. Pat. No. 6,217,072, to Gregg, for "Snowboard Pole System," describes a collapsible snow pole for use by snowboarders. Again, the described device uses a telescoping mechanism which is subject to the problems and limitations set forth above.

U.S. Pat. No. 5,941,435, to Munro et al., for "Collapsible, QuickRelease Snowboarding Pole with Leg Mounting System," also describes a pole that uses a telescoping mechanism.

What is needed, therefore, is a collapsible pole that is not subject to the inherent problems and disadvantages described above with respect to telescoping poles.

What is further needed is a collapsible pole that provides sufficient strength for use as a snowboarding pole, and that can be collapsed to a small enough size so that it is easily carried by the snowboarder when not in use.

SUMMARY OF THE INVENTION

The present invention is a collapsible pole that addresses the above described limitations of the prior art and is designed for use by snowboarders.

In one aspect, the present invention is implemented as a collapsible snowboarder pole that is divided into a number of segments. The segments are stored in a housing that also functions as a handle when the pole is in use. Tent pole technology enables the segments to fold out and hold shape. The pole segments mate with one another and are held in place by an elastic cord. The cord provides sufficient elasticity to allow the user to pull apart the pole segments enough to disengage them from one another when collapsing the pole. However, unlike a tent pole, where pole segments are typically flexible so as to provide the appropriate type of structural support for a tent, the pole segments of the present invention are rigid so as to function effectively as a snow pole when mated together.

In one aspect, the pole segments fit within a hollow housing, or handle, when they are disengaged from one another.

In one aspect, the pole segments attach to one another by fitting a smaller-diameter end of one pole into a larger-diameter end of another pole. In other aspects, a sleeve or protrusion affixed to or forming part of an end of one pole mates with an end of another pole.

In one aspect, a hollow handle is provided. The handle is shaped to be easily grippable when the snow pole is in use, and can be used as a convenient storage area for housing the pole segments when not in use.

In one aspect, the handle of the collapsible pole includes one or more retractable tools, such as a flat head screwdriver, a Philips head screwdriver, a knife, a compass, and the like.

BRIEF DESCRIPTION OF THE DRAWINGS

The accompanying drawings illustrate several embodiments of the invention and, together with the description, serve to explain the principles of the invention.

DETAILED DESCRIPTION OF THE EMBODIMENTS

The present invention is now described more fully with reference to the accompanying Figures, in which several embodiments of the invention are shown. The present invention may be embodied in many different forms and should not be construed as limited to the embodiments set forth herein. Rather these embodiments are provided so that this disclosure will be complete and will fully convey the invention to those skilled in the art.

In the following description, the invention is set forth in the context of a collapsible pole for use by a snowboarder. However, one skilled in the art will recognize that the invention can be implemented or used for other purposes as well. In fact, the invention can be used to provide a collapsible pole (with attached handle) for any type of use.

Figure 1:
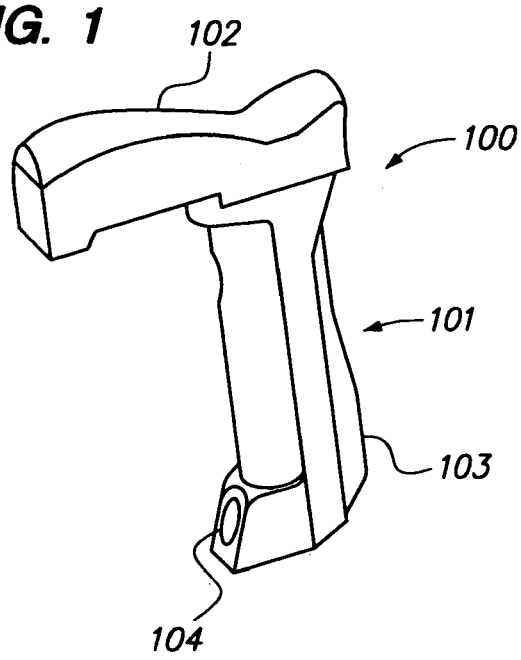
FIG. 1 is a perspective view of a handle for a collapsible snowboarder pole according to one embodiment.
Figure 2A:
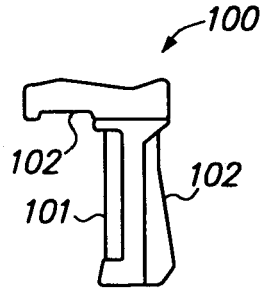
FIG. 2A is a side view of a handle for a collapsible snowboarder pole according to one embodiment.
Figure 2B:
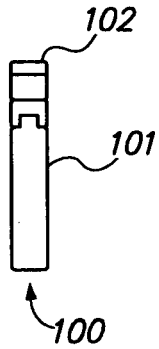
FIG. 2B is a front view of a handle for a collapsible snowboarder pole according to one embodiment.
Figure 2C:
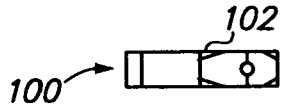
FIG. 2C is a top view of a handle for a collapsible snowboarder pole according to one embodiment.

Referring now to FIG. 1, there is shown a perspective view of a handle 100 for a collapsible snow boarder pole according to one embodiment. FIGS. 2A, 2B, and 2C show a side view, front view, and top view of handle 100, respectively. In one embodiment handle 100 is hollow so that it can serve as a housing for pole segments.

For illustrative purposes, FIG. 2C shows overall dimensions of handle 100; however, one skilled in the art will recognize that the present invention is not limited to the dimensions shown, and can be implemented using other dimensions. In one embodiment, handle 100 is 8" high and 1.625" wide. In one embodiment, the wall thickness of handle 100 is ¼".

Pole segments can be stored side-by-side within handle 100. For example, in one embodiment handle 100 can hold five cylindrical pole segments of approximately ½" diameter and approximately 6" length. Assuming one inch of overlap from one pole segment to the next, this would yield a pole of 25" total length (not including handle 100).

Figure 12A:
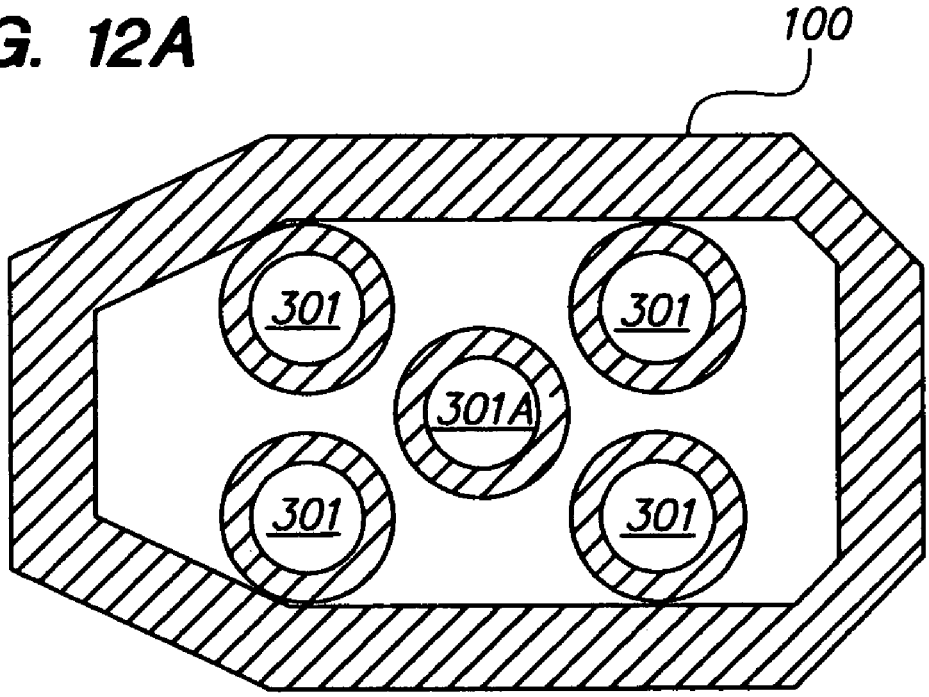
FIGS. 12A and 12B are cross-sectional views of the handle of the present invention showing storage of pole segments therein.
Figure 12B:
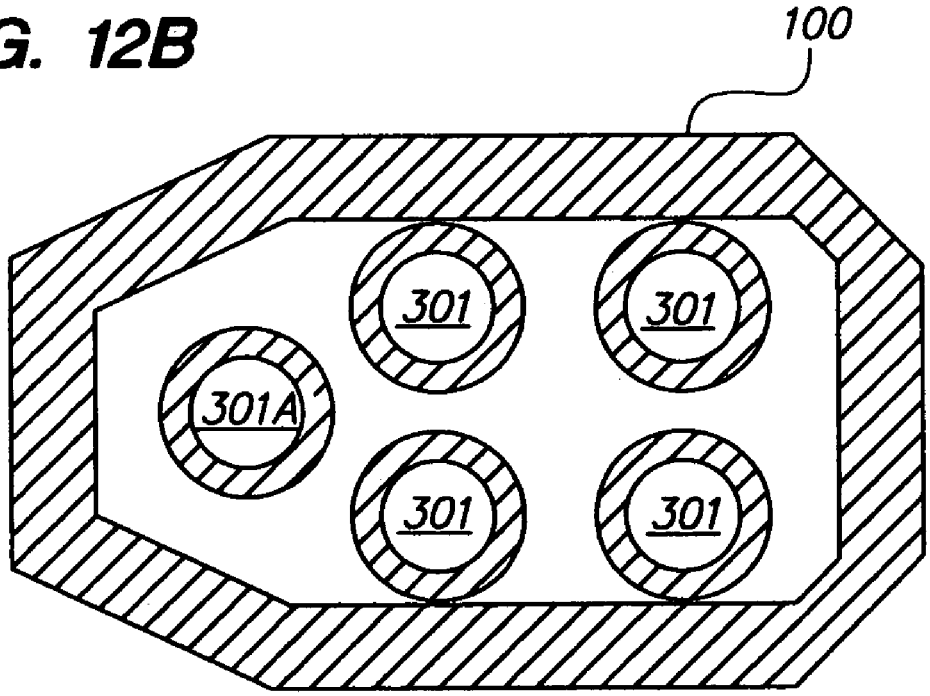

Referring now to FIGS. 12A and 12B, there are shown cross-sectional views of handle 100 depicting examples of storage arrangements for pole segments 301A, 301 within handle 100. FIG. 12A shows one possible arrangement of pole segments 301A, 301. FIG. 12B shows another possible arrangement of pole segments 301A, 301. In one embodiment, handle 100 is 1.625" wide (outer dimension). In one embodiment, pole segments 301A, 301 have an outer diameter of 0.5" and an inner dimension of 0.3". In one embodiment, handle 100 provides sufficient space to allow for a ⅛" buffer zone between segments 301A, 301 to provide adequate spacing for segments 301A, 301.

In one embodiment, as discussed below, pole segment 301A is attached to and swivels out from handle 100, while remaining pole segments 301 are attached to segment 301A via an elastic cord (described in further detail below).

In one embodiment, handle 100 includes vertical grip 101 that is gripped by the snowboarder when using the pole for pulling, and upper horizontal grip 102 that is gripped by the snowboarder for both pushing and pulling.

Figure 10A:
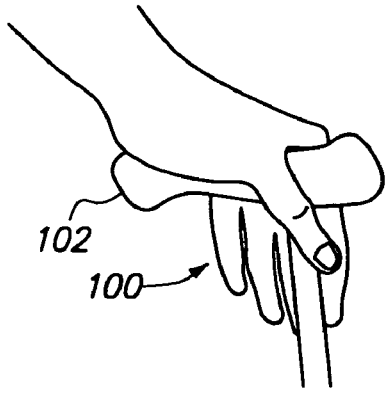
FIGS. 10A and 10B depict an example of the use of the snowboarder pole of the present invention to propel oneself by pushing off.
Figure 10B:
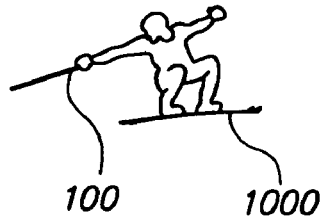
Figure 11A:
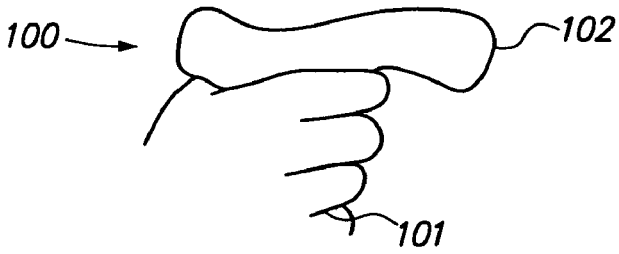
FIGS. 11A, 11B, and 11C depict an example of the use of the snowboarder pole of the present invention to propel oneself by pulling with two hands.
Figure 11B:
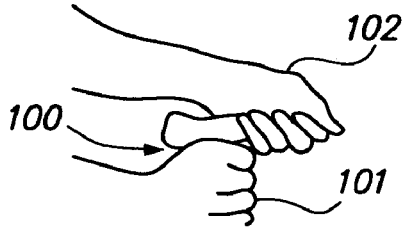
Figure 11C:
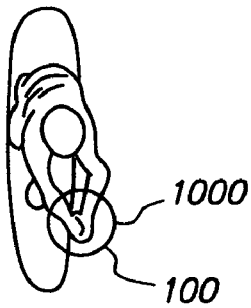

Depending on the terrain and circumstances, snowboarders can use the pole of the present invention for either pushing or pulling. Referring now to FIGS. 10A and 10B, there is shown an example of the use of the snowboarder pole of the present invention to push off. Snowboarder 1000 puts the pole in the snow and pushes down on upper horizontal grip 102 of handle 100 in order to propel him- or herself. Referring now to FIGS. 11A, 11B, and 11C, there is shown an example of the use of the snowboarder pole of the present invention to pull oneself forward. Snowboarder 1000 puts the pole in the snow, and grips vertical grip 101 with one hand and horizontal grip 102 with the other hand. Snowboarder 1000 then has sufficient leverage to pull on handle 100 in order to propel him- or herself.

In one embodiment, both grips 101, 102 are shaped to fit a snowboarder's hand within a glove or mitten.

Figure 7:
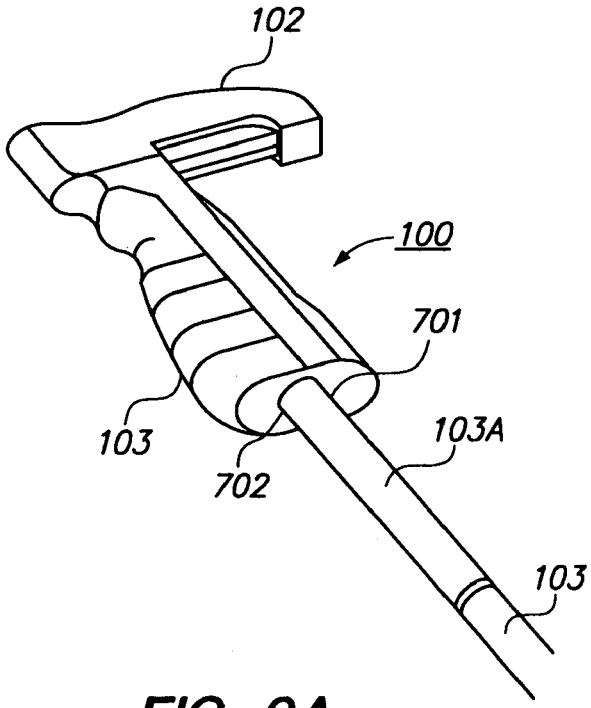
FIG. 7 is a detail view showing a pole segment attached to a handle, according to one embodiment.

In one embodiment, handle 100 includes door 103 that can be opened, for example by pressing on release button 104, to gain access to pole segments within. According to various embodiments, door 103 can be designed to open in any number of ways, whether by button, lever, or latch, and can be pushed open either manually or via a spring-loaded mechanism (not shown). Referring briefly to FIG. 7 at the bottom of door 103 is notch 702 which aligns with notch 701 in the bottom of handle 100 to provide an opening through which a first pole segment can protrude. In one embodiment, door 103 contains a latch or clip (not shown) that holds it in the closed position until button 104 is pressed again. In one embodiment door 103 is spring-loaded so that once opened it stays open until pressed shut.

Figure 3A:
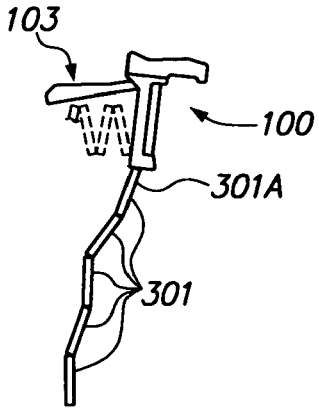
FIG. 3A depicts an embodiment of the present invention where a series of pole segments are being pulled out of the handle.
Figure 3B:
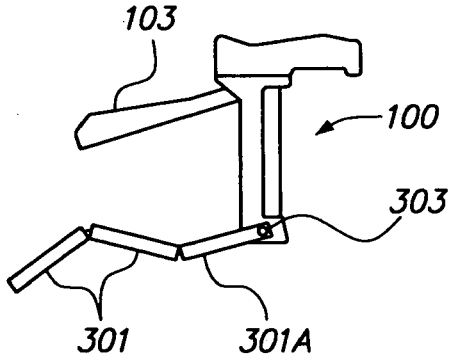
FIG. 3B depicts rotation of the first pole segment about a fulcrum in the handle.

Referring now to FIG. 3A, there is shown a series of pole segments 301 being pulled out of handle 100. Segments 301 may be disposed to fall out of handle 100 when button 104 is pressed; alternatively, segments 301 may be launched out of handle 100 by a spring-loaded action, or they can be pulled out manually by the user. As shown in FIG. 3B, first segment 301A pivots around fulcrum 303 located near the bottom end of handle 100, and protrudes through notch 701 in the bottom of handle 100.

Referring now also to FIG. 7, there is shown a detail view showing pole segment 301A attached to handle 100, according to one embodiment. When door 103 is closed, first segment 301A is locked in place by the combination of notch 702 in door 103 and notch 701 in handle 100. Notches 701 and 702 match up with one another to provide an opening through which pole segment 301A protrudes.

Figure 4:
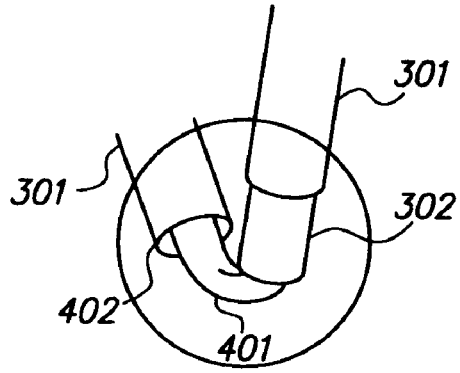
FIG. 4 depicts an embodiment for mating two pole segments, wherein a first pole segment end fits inside the end of a second pole segment.

In one embodiment, segments 301 are attached to segment 301A and to one another via "tent pole" mechanism; an elastic cord runs through the segments 301, 301A to hold them together when mated. Segments 301, 301A are hollow, and in one embodiment are cylindrical in shape. Referring now to FIG. 4, there is shown a mechanism for mating two pole segments 301 according to one embodiment. Smaller male end 302 of one pole segment 301 fits inside larger female end 402 of another pole segment 301. The user unfolds the pole by fitting each male end 302 into a corresponding female end 402. As elastic cord 401 contracts, it pulls the female and male parts 402, 403 of the mating pole segments 301 together and holds them in place while the pole is being used. Smaller male end 302 may either be an integral part of pole segment 301, or it may be a protrusion attached to the end of pole segment 301.

Figure 6:
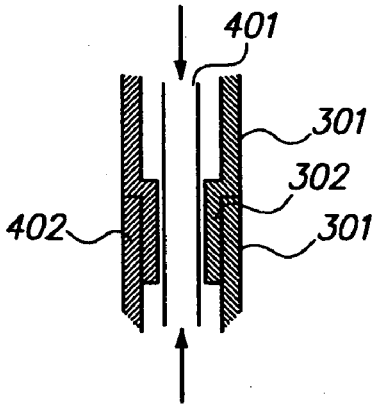
FIG. 6 is a cross-sectional view showing two pole segments mating with one another, according to one embodiment.

Referring now to FIG. 6, there is shown a cross-sectional view depicting two pole segments 301 mating with one another, according to one embodiment. In the example shown, segments 301 are hollow cylinders. Male end 302 of one segment 301 is mated with female end 402 of the other segment 301. Cord 401 runs through the centers of segments 301 to keep them mated with one another.

Figure 8:
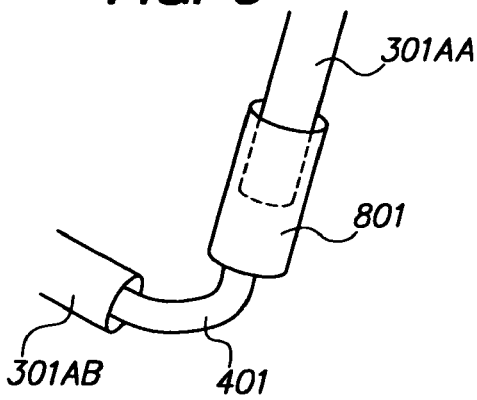
FIG. 8 depicts an alternative embodiment for mating two pole segments, wherein a sleeve affixed to a first pole segment end mates with an end of a second pole segment.

Referring now to FIG. 8, there is shown an alternative mating mechanism. Sleeve 801 is affixed to segment 301AA so that the end of sleeve 801 extends beyond the end of segment 301AA, forming a seat for receiving of an end of segment 301AB. The two segments 301AA, 301AB are mated with one another by inserting an end of segment 301AB into sleeve 801. The inner diameter of sleeve 801 is sized to approximately match the outer diameter of segments 301AA and 301AB so as to provide a snug fit. Elastic cord 401 keeps segments 301AA, 301AB mated with one another as described above.

One skilled in the art will recognize that other mating techniques can also be used. For example, the ends of segments 301 can be threaded to match one another, so as to provide extra strength, particularly when pulled on.

Figure 3C:
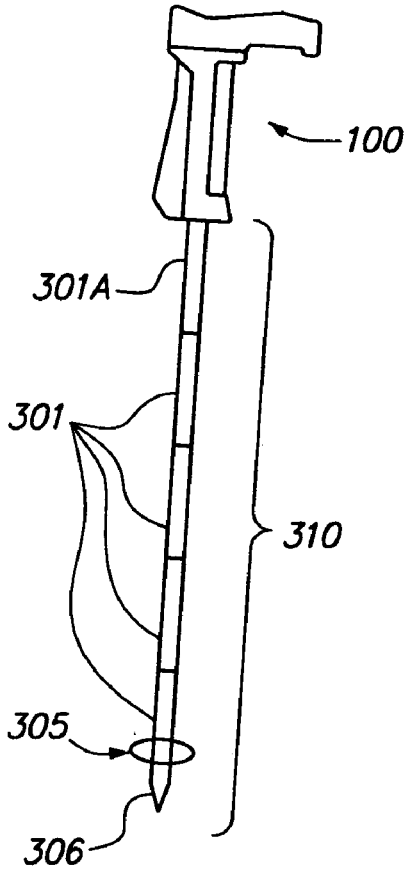
FIG. 3C depicts a collapsible snowboarder pole in its extended position, according to one embodiment.

Referring now to FIG. 3C, there is shown collapsible snowboarder pole 310 in its extended position, according to one embodiment. Segments 301, 301A are mated with one another, and segment 301A is held in place within handle 100. In one embodiment, the last segment 301 has a pointed end 306 and a round basket 305 mounted transversely near end 306 to keep pole 310 from penetrating too far into the snow.

When pole 310 is fully extended, the resulting structure has strong compression strength to enable the snowboarder to push off, and strong bending strength to enable the snowboarder to pull himself or herself forward. The torsion strength of pole 310, the elastic cord 401, is strong enough to keep segments 301 from sliding apart from one another, yet mild enough to enable the user to pull apart segments 301 for folding.

In one embodiment, elastic cord 401 is made of rubber, elastic thread, cotton, polyester, acrylic, polypropylene, nylon, rayon, or any combination thereof. In one embodiment, segments 301A, 301 are made of aluminum or carbon fiber.

Figure 5:
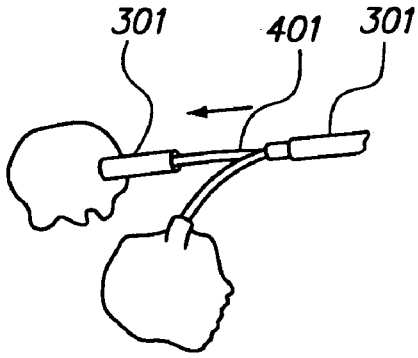
FIG. 5 depicts a technique for unmating pole segments so that that the pole can be collapsed, according to one embodiment.

After use, as shown in FIG. 5, the user folds up the pole by pulling segments 301 apart, stretching elastic cord 401 and detaching the female and male parts 402, 403 from one another. With the extra slack in cord 401, the user folds segments 301 back onto each other. The user presses button 104 to open door 103, pivots first segment 301A around pivot point 303, places all segments 301, 301A inside handle 100, and closes door 103.

Figure 9A:
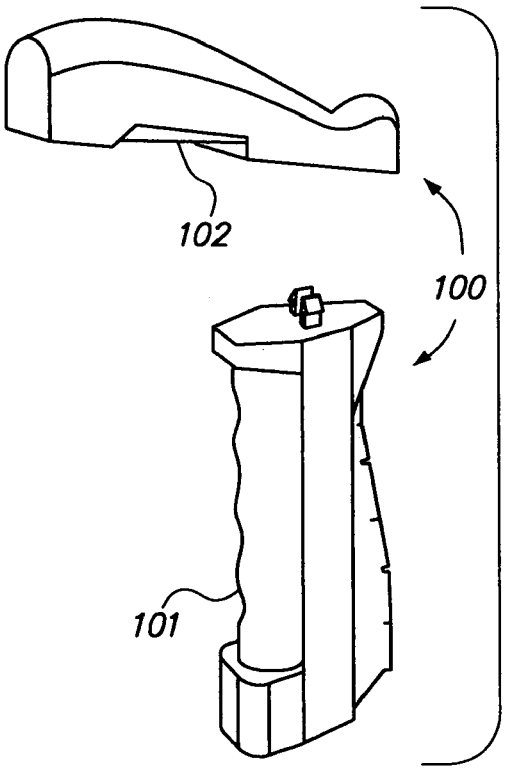
FIG. 9A illustrated detachability of two grips of the handle.

In one embodiment, grips 101 and 102 can be separated from one another, as shown in FIG. 9A. A latch or button (not shown) releases the two portions of handle 100 so that they can be separated.

Figure 9B:
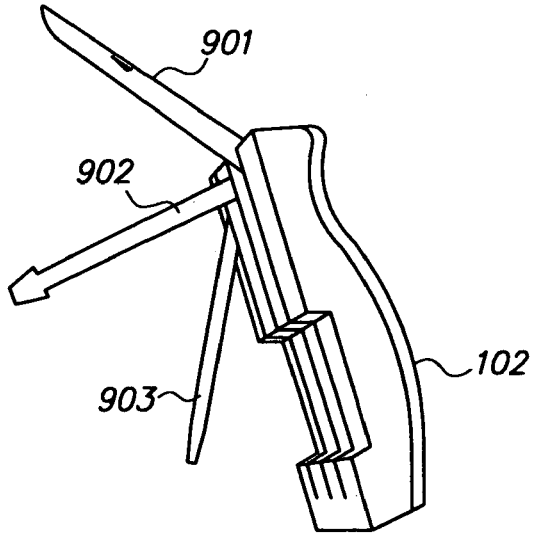
FIG. 9B depicts retractable tools that fit within the handle of the snowboarder pole according to one embodiment.

In one embodiment, retractable tools are provided within handle 100. For example, as shown in FIG. 9B, tools such as knife 901, flathead screwdriver 902, and Philips screwdriver 903 can be folded out from grip 102.

In the above description, for purposes of explanation, numerous specific details are set forth in order to provide a thorough understanding of the invention. It will be apparent, however, to one skilled in the art that the invention can be practiced without these specific details.

For example, one skilled in the art will recognize that the pole of the present invention can be used for other purposes than snowboarding, including any activity where a pole is useful but where collapsibility is an advantage.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

As will be understood by those familiar with the art, the invention may be embodied in other specific forms without departing from the spirit or essential characteristics thereof. For example, the particular architectures depicted above are merely exemplary of one implementation of the present invention. The functional elements and method steps described above are provided as illustrative examples of one technique for implementing the invention; one skilled in the art will recognize that many other implementations are possible without departing from the present invention as recited in the claims. Likewise, the particular capitalization or naming of the modules, protocols, features, attributes, or any other aspect is not mandatory or significant, and the mechanisms that implement the invention or its features may have different names or formats. In addition, the present invention may be implemented as a method, process, user interface, computer program product, system, apparatus, or any combination thereof. Accordingly, the disclosure of the present invention is intended to be illustrative, but not limiting, of the scope of the invention, which is set forth in the following claims.

What is claimed is:

1. A collapsible snow pole, comprising:

a housing;

a first hollow rigid pole segment, attachable to the housing and having an end capable of mating with an end of another pole segment;

a plurality of additional hollow rigid pole segments, each having at least one end capable of mating with an end of another pole segment; and an elastic cord disposed within the first pole segment and the additional pole segments, for securing the pole segments in a mated position with respect to one another, the elastic cord having sufficient elasticity to allow the pole segments to be pulled apart;

wherein the housing is adapted to storing the pole segments when they are not mated with one another.

2. The collapsible pole of claim 1, wherein each pole segment is cylindrical.

3. The collapsible pole of claim 1, wherein each pole segment is metal.

4. The collapsible pole of claim 1, wherein one of the additional pole segments comprises a pole end segment, the pole end having a pointed end, opposite its mating end, for engagement with snow.

5. The collapsible pole of claim 4, wherein the pole end segment further comprises a basket mounted transversely for inhibiting excessive penetration of the pole into the snow.

6. The collapsible pole of claim 1, wherein each pole end capable of mating with an end of another pole segment comprises one selected from the group consisting of:

a female end having an inner dimension; and a male end capable of being inserted into the female end of another pole segment;

wherein an outer dimension of the male end of one pole segment is substantially equal to an inner dimension of the female end of another pole segment.

7. The collapsible pole of claim 6, wherein each outer dimension comprises an outer diameter and each inner dimension comprises an inner diameter.

8. The collapsible pole of claim 1, wherein the housing is handle-shaped.

9. The collapsible pole of claim 1, wherein the housing comprises a substantially L-shaped handle.

10. The collapsible pole of claim 9, wherein the substantially L-shaped handle comprises:

a horizontal grip portion having a top surface shaped to fit a user's hand when pushing down on the pole; and a vertical grip portion shaped to fit a user's hand when using the pole for pulling.

11. The collapsible pole of claim 10, wherein the horizontal grip portion is positioned to prevent the user's hand from sliding off the handle when pulling on the vertical grip portion of the handle.

12. The collapsible pole of claim 10, wherein the horizontal grip portion is shaped to fit a user's second hand when the user's first hand pulls on the vertical grip portion.

13. The collapsible pole of claim 1, wherein the housing comprises a hollow handle adapted to storage of tools.

14. The collapsible pole of claim 1, wherein the housing comprises a door having a closed position for use when storing the pole segments and an open position for use when the pole segments are mated with one another.

15. The collapsible pole of claim 14, wherein the first pole segment is rotatably coupled to the housing via a pivot, and wherein the pole segment has a first orientation with respect to the pivot when pole segments are stored and a second orientation with respect to the pivot when the pole segments are mated with one another.

16. The collapsible pole of claim 14, further comprising a latch for opening the door.

17. The collapsible pole of claim 14, further comprising a button for opening the door.

18. The collapsible pole of claim 14, further comprising a lever for opening the door.

19. The collapsible pole of claim 14, wherein the door is spring loaded.

20. A collapsible snow pole, comprising:

a housing;

a first hollow rigid pole segment, attachable to the housing and having an end capable of mating with an end of another pole segment;

a plurality of additional hollow rigid pole segments, each having at least one end capable of mating with an end of another pole segment; and an elastic cord disposed within the first pole segment and the additional pole segments, for securing the pole segments in a mated position with respect to one another, the elastic cord having sufficient elasticity to allow the pole segments to be pulled apart;

wherein the housing comprises at least one retractable tool.

21. A collapsible snow pole, comprising:

a housing;

a first hollow rigid pole segment, attachable to the housing;

a plurality of additional hollow rigid pole segments;

further comprising at least one sleeve affixed to one of the hollow rigid pole segments and having an end extending beyond the end of the affixed pole segment, the end of the sleeve being capable of mating with an end of another pole segment; and an elastic cord disposed within the first pole segment, the additional pole segments, and the at least one sleeve, for securing the sleeve to the mated pole segment, the elastic cord having sufficient elasticity to allow the sleeve and the pole segment to be pulled apart;

wherein the housing is adapted to storing the pole segments when they are not mated with one another.

22. The collapsible pole of claim 21, wherein:

the sleeve has an inner dimension; and the pole segment matable with the sleeve has an outer dimension substantially equal to the inner dimension of the sleeve.

23. A collapsible snow pole, comprising:

a housing;

a first hollow rigid pole segment, attachable to the housing;

a plurality of additional hollow rigid pole segments;

wherein at least one of the pole segments comprises a protrusion at its end, the protrusion being capable of mating the an end of another pole segment; and an elastic cord disposed within the first pole segment and the additional pole segments, for securing the protrusion to the mated pole segment, the elastic cord having sufficient elasticity to allow the protrusion and the pole segment to be pulled apart;

wherein the housing is adapted to storing the pole segments when they are not mated with one another.

24. The collapsible pole of claim 23, wherein:

the protrusion has an outer dimension; and the pole segment matable with the protrusion has an inner dimension substantially equal to the outer dimension of the protrusion.

* * * * *